US010400356B2

(12) United States Patent
Rüf et al.

(10) Patent No.: US 10,400,356 B2
(45) Date of Patent: Sep. 3, 2019

(54) FLAME-RETARDANT LYOCELL FIBERS AND USE THEREOF IN FLAME BARRIERS

(75) Inventors: Hartmut Rüf, Schörfling (AT); Gert Kroner, Lenzing (AT); Peter Dobson, Derby (GB); Johann Männer, Weyregg (AT); Christoph Schrempf, Bad Schallerbach (AT)

(73) Assignee: LENZING AKTIENGESELLSCHAFT, Lenzing (AT)

( * ) Notice: Subject to any disclaimer, the term of this patent is extended or adjusted under 35 U.S.C. 154(b) by 0 days.

(21) Appl. No.: 13/501,684

(22) PCT Filed: Oct. 12, 2010

(86) PCT No.: PCT/IB2010/002819

§ 371 (c)(1),
(2), (4) Date: Jun. 26, 2012

(87) PCT Pub. No.: WO2011/045673

PCT Pub. Date: Apr. 21, 2011

(65) Prior Publication Data

US 2012/0258643 A1 Oct. 11, 2012

Related U.S. Application Data

(60) Provisional application No. 61/251,070, filed on Oct. 13, 2009.

(51) Int. Cl.
*D01F 1/07* (2006.01)
*D01F 2/00* (2006.01)
(Continued)

(52) U.S. Cl.
CPC ..... *D01F 2/00* (2013.01); *A47C 31/001* (2013.01); *D01F 1/07* (2013.01); *D04H 1/413* (2013.01); *Y10T 442/696* (2015.04)

(58) Field of Classification Search
CPC ..... A47C 31/001; D01F 1/07; D01F 2/00; D04H 1/413
(Continued)

(56) References Cited

U.S. PATENT DOCUMENTS 4,062,687 A 12/1977 Mauric et al.
5,417,752 A 5/1995 Paren et al.
(Continued)

FOREIGN PATENT DOCUMENTS

DE 845 230 C 7/1952
DE 26 22 569 A1 12/1976
(Continued)

OTHER PUBLICATIONS

International Search Report and Written Opinion issued in International Patent Application No. PCT/IB2010/002819 dated Aug. 3, 2011—9 pages.
(Continued)

*Primary Examiner* — Vincent Tatesure
(74) *Attorney, Agent, or Firm* — Venable LLP

(57) ABSTRACT

The present invention relates to flame-retardant Lyocell fibers which include incorporated inorganic additives which are particularly suited for use in flame barriers for articles of manufacture, such as mattresses and upholstered furniture applications.

9 Claims, 1 Drawing Sheet

(51) Int. Cl.
*A47C 31/00* (2006.01)
*D04H 1/413* (2012.01)

(58) Field of Classification Search
USPC ..... 442/414, 181, 136, 302
See application file for complete search history.

(56) References Cited

U.S. PATENT DOCUMENTS

| | | | | |
|---|---|---|---|---|
| 5,589,125 | A | 12/1996 | Zikeli et al. | |
| 6,130,327 | A | 10/2000 | Wolf et al. | |
| 6,669,882 | B2 | 12/2003 | Seok | |
| 6,670,291 | B1 * | 12/2003 | Tompkins et al. | 442/136 |
| 6,893,492 | B2 | 5/2005 | White et al. | |
| 7,150,059 | B2 | 12/2006 | Small, Jr. et al. | |
| 7,709,089 | B2 | 5/2010 | Fushitani et al. | |
| 2002/0014716 | A1 | 2/2002 | Seok | |
| 2004/0198125 | A1 * | 10/2004 | Mater et al. | 442/394 |
| 2004/0226100 | A1 | 11/2004 | Small, Jr. et al. | |
| 2005/0023509 | A1 | 2/2005 | Bascom et al. | |
| 2005/0051054 | A1 | 3/2005 | White et al. | |
| 2008/0233821 | A1 * | 9/2008 | Ruf et al. | 442/181 |
| 2009/0030131 | A1 | 1/2009 | Fushitani et al. | |

FOREIGN PATENT DOCUMENTS

| | | | |
|---|---|---|---|
| DE | 10115941 | A1 | 12/2001 |
| DE | 10324232 | A1 | 12/2004 |
| EP | 0 584 318 | B1 | 5/1996 |
| EP | 0 619 848 | B1 | 1/1999 |
| EP | 0 836 634 | B1 | 10/2002 |
| EP | 1 649 095 | A1 | 4/2006 |
| EP | 1 798 318 | A1 | 6/2007 |
| EP | 1 918 431 | A1 | 5/2008 |
| GB | 338654 | A | 11/1930 |
| KR | 2009-0102110 | A | 9/2009 |
| WO | 2005/012617 | A1 | 2/2005 |
| WO | 2007/022552 | A1 | 3/2007 |

OTHER PUBLICATIONS

Horrocks, A. R. and Kandola, B. K.: "Flame retardant cellulosic textiles" in Spec. Publ.—R. Soc. Chem. Band 224 (1998) pp. 343-362.

"Functional fillers for plastics", chapter 13; Ed. Marino Xanthos, Verlag Wiley VCH, (2005) pp. 221-239.

"Non-Woven Textile Fabrics", Kirk-Othmer Encyclopedia of Chemical Technology, 3rd Ed., vol. 16 (1978) pp. 72-124.

* cited by examiner

Fig. 1: Mattress panel in order from top to bottom
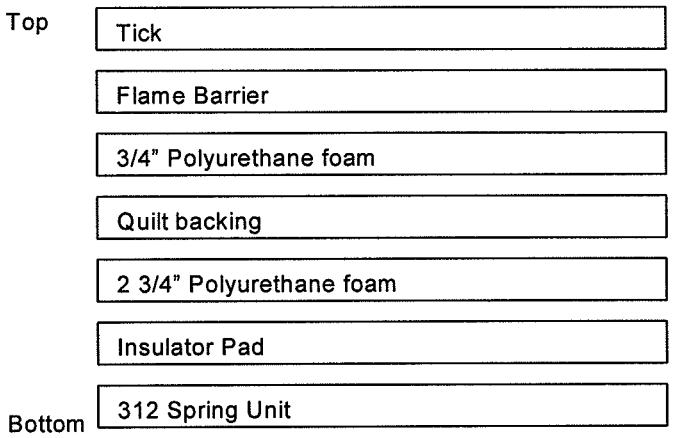
Fig. 2: Mattress border
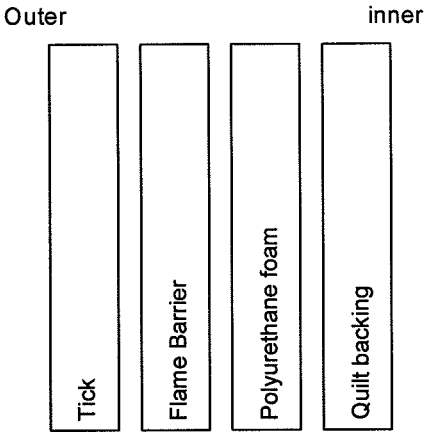
Fig. 3: Foundation in order from outer to inner
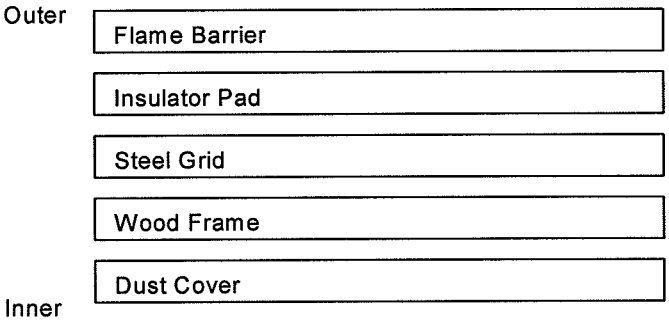

FLAME-RETARDANT LYOCELL FIBERS AND USE THEREOF IN FLAME BARRIERS

BACKGROUND OF THE INVENTION

The present invention relates to flame-retardant Lyocell fibers which include inorganic additives incorporated therein and to their use in flame barriers, for example, in mattresses, upholstered furniture and other articles of manufacture.

Flame-retardant fibers are useful in the preparation of numerous articles of manufacture, for example, mattresses, upholstery, cars, airplanes, clothing, carpeting, etc. There is a particular need for flame-retardant fibers for use in flame barriers in mattresses and upholstered furniture.

A high number of deaths and serious injuries caused by burning mattresses were the reason for the Californian government in 2001 to begin development of a standard for the flame retardancy of these products. In 2005 the Californian standard TB 603 came into force and was adopted in the whole U.S.A. in slightly amended form under 16 CFR 1633 "Standard for the flammability of mattress sets". According to this standard the mattress maintains flame and heat resistant integrity when subjected to gas flames (two propane-fed burners—one from the side, one from above for a period of 30 minutes) to simulate for burning bedding. The criteria for passing the test are as follows:

1. The peak rate of heat release during the whole test must not exceed 200 kW.

2. The total heat release in the first 10 minutes of the test must not exceed 15 MJ.

Mattresses which are tested according to 16 CFR 1633 usually have a multilayer construction, wherein at least one of the layers is a flame barrier. This flame barrier can be a woven or nonwoven fabric, which may be impregnated with a flame-retardant compound in aqueous solution, e.g. ammonium phosphate. This kind of flame-retardant treatment has the disadvantage that under the influence of humidity the flame-retardant compound may migrate out of the flame barrier.

Further the flame barrier may consist of inherently flame-retardant fibers like e.g. glass fibers, polyaramide, polybenzimidazole or melamine fibers.

A third type of flame barrier consists of fibers which are made flame-retardant by incorporating into the bulk of the fiber a flame-retardant additive.

All three approaches for a flame barrier may be combined in the form of fiber blends as well as by applying a final flame-retardant finish.

The overview by Horrocks, A. R. and Kandola, B. K.: "Flame retardant cellulosic textiles" in "Spec. Publ.—R. Soc. Chem. Band 224 (1998) pp. 343-362" describes the numerous approaches to make cellulosic fibers flame-retardant. The most common flame-retardant compounds for cellulose are organic or inorganic phosphorous compounds, whereby these phosphorous compounds are either applied as a finish treatment (the so-called "topical treatment") of the fabric, which is especially used for cotton, or by using cellulosic fibers wherein a flame-retardant organic phosphorous compound is incorporated during the spinning process. The process of incorporation of a flame-retardant pigment during the spinning process is described e.g. in DE 2622569 or EP 836634. Due to the higher price of the flame-retardant organic phosphorous compound such cellulosic fibers are used preferably in textile materials which have to pass the vertical flame test according to ISO 15025. For lower flame retardancy requirements mainly inorganic additives will be used.

As a cheaper alternative to the phosphorus containing fibers flame-retardant fibers containing silica are described e.g. in EP 619848 or EP 1918431. But these fibers can only be produced by the viscose process and the yield of the silica in the final fiber is very small compared to the amount of sodium silicate used.

U.S. Pat. No. 6,893,492 discloses cellulosic fibers containing montmorillonite. These fibers show improved thermal properties compared to non-incorporated fibers, expressed as a higher residue (char) in the thermogravimetric analysis.

WO 2007/022552 discloses cellulosic fibers with incorporated unmodified hectorite for the use in products which should pass the Californian standard TB 604.

Numerous patent publications describe the use of cellulosic fibers or flame-retardant cellulosic fibers as flame barriers or as elements in mattress constructions: For example U.S. Pat. No. 7,150,059 claims the use of cellulosic fibers and especially silica-incorporated fibers for flame barriers in products which shall pass the TB 603 test. EP 1649095 claims a cellulosic nonwoven material for the use as flame barrier in mattresses which retains at least 10 percent of its fiber weight after a defined heat treatment.

As described above, silica-containing cellulosic fibers, which are made by incorporation of sodium silicate into the viscose before spinning, show a low silica yield. They can be produced only by the viscose process and because an acid process stage is needed for the formation of silicic acid from the incorporated sodium silicate they can for example not be produced by the ecologically friendly Lyocell process. Additionally the flame-retardant effect of silicic acid is low and a high percentage of silicic acid in the fibers is necessary which leads to very low mechanical properties considering the already low tenacity of the base viscose fibers. For example with a silicic acid loading of 30% to 33% in fiber the tenacity is only 12 to 15 cN/tex.

To be suitable to be incorporated in a reliable commercial scale spinning process the mentioned alternatives of flame-retardant additives montmorillonite and hectorite have to be of very high quality. This results in high production costs which are unacceptable for products in typical markets for TB 603 products.

Besides the inorganic substances mentioned above there are numerous other inorganic compounds which may be added to fibrous and/or cellulosic materials for specific purposes.

Kaolin is a crystalline clay mineral with a two dimensional sheet structure composed of units of one layer of silica tetrahedrons and one layer of alumina octahedrons. In contrast to this clays like montmorillonite or hectorite have three-dimensional structures.

Kaolin is extensively used in many industrial applications as e.g. plastics, paper, ceramics, rubber and paint. Kaolin as a filler for synthetic polymers is described in detail in the book "Functional fillers for plastics", chapter 13; Ed. Marino Xanthos, Verlag Wiley VCH. Most of the kaolin is used in the paper industry as a coating and filler material. It is also disclosed among others for flame-retardant topical treatments of cellulosic materials in GB338654 and as a flame-retardant coating in US 2004/0226100. It is also known from DE845230 that kaolin in an amount of up to 5-10% (w/w) can be used as a matting agent for viscose fibers. DE10115941 describes the use of up to 10% of mineral additives in fibers, among others kaolin, in viscose fiber. The content of matting agent in the examples of the DE10115941 is 2% (w/w). In this low amount in the fiber of 2% up to 5-10% (w/w) kaolin will not show a considerable flame-retardant effect.

In EP 1798318 kaolin is disclosed among other inorganic compounds as a component of a halogen (chlorine) containing synthetic fiber composite for use in upholstered furniture. However there is increased reluctance to use a fiber in household products which emits hydrogen chloride when ignited.

Therefore there was a need for flame barrier materials which fulfill the requirements of standard 16 CFR 1633 and TB 603 as well as exhibiting sufficient mechanical properties and which can be produced without ecological and economical disadvantages.

SUMMARY OF THE INVENTION

This problem can be solved by the flame-retardant Lyocell fibers of the invention which contain medium to high amounts, especially between 12 and 50% (w/w) of incorporated inorganic additives. In a particularly preferred embodiment, the flame-retardant fibers of the invention include kaolin, which is added to the dope during the spinning process.

The flame-retardant fibers of the invention are useful in flame barriers for mattresses, upholstered furniture and other articles of manufacture, such as cars, airplanes, carpeting, etc. Mixtures of more than one individual inorganic additive are possible, too. Preferably the inorganic additive is kaolin or talc. A mixture of one of these preferred additives together with other inorganic additives is suitable, too. Surprisingly it was found that such incorporated Lyocell fibers exhibit not only excellent flame-retardant properties in the test according to 16 CFR 1633, but also maintain, in spite of the high amount of incorporated additive, mechanical properties good enough to enable modern processing methods into nonwovens and other fabrics as well as mechanical resistance as necessary for the intended applications.

DETAILED DESCRIPTION OF THE INVENTION

The excellent flame-retardant properties of the preferred kaolin-incorporated Lyocell fibers for use as flame barrier in the test 16 CFR 1633 may be tentatively explained as follows: The essential point which makes fibers suitable as flame barrier in the test above seems to be the ability to form after action of a flame a carbonaceous stable, heat insulating layer which prevents the breaking open and loss of the integrity of the mattress. The idea that it is really the ability to form a stable charred layer which retains some strength after being exposed to flame and not a general flame-retardant effect is supported by the surprising fact that a Lyocell fiber containing a known flame-retardant aluminum hydroxide does not pass 16 CFR 1633 (as shown in the examples). Also another known filler, calcium carbonate, incorporated in Lyocell fibers, does not pass 16 CFR 1633 showing the surprising difference to kaolin in passing/not passing the test. The flame barrier must be impermeable such that heat and hot gases cannot be transmitted through the fabric causing internal materials to ignite.

The fiber of the present invention is a fiber of the Lyocell type, the designation of the fiber adopted by the CIRFS (the European man-made fibers association) for cellulosic fibers produced by the direct solvent process. The solvent for the fiber of the present invention may be N-methylmorpholine-N-oxide (NMMO) or alternatively a ionic liquid known to dissolve cellulose as e.g. 1-ethyl-3-methyl-imidazolium chloride or -acetate or 1-butyl-3-methyl-imidazolium chloride or -acetate. Fibers produced with the solvent NMMO are commercially produced under the brand Tencel®. Preferably the fiber is produced by the NMMO-process.

The kaolin used in the present invention is preferably of high purity (especially heavy metal content) and have a particle size sufficiently low not to disturb the spinning process, preferred types are those used for paper coating as e.g. Miragloss® by BASF or Hydragloss® by KaMin LLC. In the production process of the Lyocell fiber the kaolin may be added either to the slurry of cellulose and aqueous NMMO or added to the spinning dope as powder or in a suitable dispersion. The Lyocell-dope containing the kaolin additive is then spun to fibers in a dry-wet spinning process according to EP 0584318 B1.

The fiber according to the present invention preferably contains between 12% kaolin and 50% kaolin in fiber, preferably between 20% and 30% in fiber. Fibers containing less than 12% kaolin in fiber show reduced flame-retardant effect in flame barriers and fibers with more than 50% kaolin in fiber suffer from low textilemechanical properties. Another preferred additive suitable in the present invention is talc. The fibers can be staple fibers of a definite length or continuous filaments.

The fibers described herein may be processed to textile structures by any way known to those skilled in the art of textile manufacturing. The fibers may be processed to knitted or woven or nonwoven structures. Preferably the fibers are processed to a nonwoven textile structure. Making of nonwoven texile products is described in "Non-Woven Textile Fabrics" Kirk-Othmer Encyclopedia of Chemical Technology, 3rd Ed., Vol. 16 p. 72-124. Nonwoven textile structures consisting of continuous filaments may also be made e.g. by the Meltblowing process. Manufacturing of the flame barrier of the present invention can include chemical, thermal, mechanical bonding or no additional bonding after web formation of a nonwoven flame barrier product.

Preferably the flame barrier described herein is a high loft nonwoven product. The term "high loft" is used for nonwoven fiber products not densified or purposely compressed over a significant portion of the product in the manufacturing process preferably having a greater volume of air than fiber, i.e. more than 50% of the material volume is air. The high-loft nonwoven material typically has a thickness of more than 6 mm. Typical products for the market "flame barrier" are either carded or air laid and thermally bonded.

The flame barrier of the present invention may comprise besides the Lyocell fibers comprising incorporated inorganic additive one or more other fiber types of natural or synthetic origin. The fiber blend may include inherent flame-retardant fibers such as e.g. aramid, arimid, melamine or novoloid fibers. The fiber blend may include fibers made flame-retardant by including a flame-retardant monomer in the polymer or incorporation of a flame-retardant additive as e.g. modacrylics, polyvinylchloride, polyvinylidenechloride or flame-retardant polyester fibers. The fiber blend may include natural fibers such as cellulosics (e.g. cotton) or wool. The fiber blend may include synthetic fibers such as e.g. polyester, polyamide, polyurethane, polyolefin or polyacrylonitrile fibers. The fiber blend may include polyester fibers made from natural raw materials such as e.g. polylactic acid fibers. Typical products for the market "flame barrier" are blends of cellulosics with synthetic fibers.

The flame barrier according to the present invention may contain between 20% and 100%, preferably between 30% and 70% of the kaolin containing fiber.

The flame barrier according to the present invention may get an additional flame-retardant topical treatment. Such topical treatments are well-known to the expert as described at the beginning.

Such Lyocell fibers could also find application in areas such as automotives, trains and airplanes as lightweight sound or flame barriers.

The invention will now be illustrated by examples. These examples are not limiting the scope of the invention in any way.

Examples 1 to 2

Kaolin (Miragloss 90, from BASF) was added to a dope of sulfite pulp in aqueous N-Methylmorpholine-N-oxide in certain amounts being sufficient to give a resulting amount of 15 resp. 30% (w/w) in the fiber. This dope was spun into 3,3 dtex fibers according to the well-known dry-jet-wet spinning method. The textile mechanical properties of the resulting fibers are shown in Table 1.

TABLE 1

| Example | Fiber type | Additive | Additive content % (w/w) | Tenacity cond. cN/tex | Elongation cond. % |
|---|---|---|---|---|---|
| 1 | Lyocell | Kaolin | 15 | 22.2 | 11.3 |
| 2 | Lyocell | Kaolin | 30 | 18.8 | 13.3 |
| 3 | Lyocell | Aluminum hydroxide | 15 | 25.9 | 10.1 |
| 4 | Lyocell | Aluminum hydroxide | 30 | 17.9 | 14.1 |
| 5 | Lyocell | Calcium carbonate | 15 | 19.1 | 10.3 |
| 6 | Lyocell | Calcium carbonate | 30 | 15.6 | 13.0 |
| 7 | Viscose | Kaolin | 23 | 13.7 | 15.4 |
| 8 | Viscose | Kaolin | 40 | 8.0 | 16.9 |

The examples clearly show that the mechanical properties of the fibers decrease with increasing content of the incorporated inorganic additives. But even with 30% of incorporated inorganic additives they are sufficient for the use in flame barriers for mattresses and upholstered furniture.

Comparative example 3 to 4Lyocell-fibers were spun in the same way as in example 1 to 2. However, instead of kaolin aluminum hydroxide was incorporated to give fibers with 15% and 30% aluminum hydroxide respectively. The textile mechanical properties of the resulting fibers are shown in Table 1.

Comparative Example 5 to 6

Lyocell-fibers were spun in the same way as in example 1 to 2. However, instead of kaolin calcium carbonate was incorporated to give fibers with 15% and 30% calcium carbonate respectively. The textile mechanical properties of the resulting fibers are shown in Table 1.

Comparative Example 7 to 8

Viscose fibers 1,7 dtex were spun in a conventional, well-known way. Kaolin was incorporated to give fibers with 23% and 40% kaolin respectively. The textile mechanical properties of the resulting fibers are shown in Table 1. Compared to the fibers according to inventive examples 1 and 2 the tenacity was very low and the spinning behavior was quite bad.

Examples 9 to 14

The fibers of examples 1 to 6 were blended with cotton and polyester fibers in the ratios as shown in Table 2, carded and slightly needle-punched to give high-loft nonwoven materials of square weight and thickness described in Table 2. Additionally the thickness was measured according to EN-ISO 9073-2.

These materials were used to manufacture mattresses for burn tests. The construction of the mattresses to be tested according to 16 CFR 1633 was as shown in FIGS. 1 to 3, wherein FIG. 1 shows the construction of the mattress panel in order from top to bottom, FIG. 2 shows the mattress border and FIG. 3 shows the foundation in order from outer to inner. The burn tests were performed according to the test protocol of 16 CFR 1633. For each example three mattresses were burned. Materials will pass the 16 CFR 1633 test only if all three mattresses fulfill the test criteria.

TABLE 2

| Example | Incorporated Fibers of example | Incorporated Fibers % | Cotton % | PES % | square weight g/m$^2$ | Thickness at 0.1 kPa mm | Thickness at 0.5 kPa mm | 16CFR 1633 Test result |
|---|---|---|---|---|---|---|---|---|
| 9 | 1 | 23.4 | 40.6 | 36.0 | 291 | 13.2 | 7.2 | Pass |
| 10 | 2 | 30.5 | 50.3 | 19.2 | 262 | 12.5 | 6.5 | Pass |
| 11 | 3 | 32.5 | 35.1 | 32.4 | 289 | 11.8 | 6.9 | Fail |
| 12 | 4 | 27.0 | 29.0 | 44.0 | 270 | 10.5 | 6.4 | Fail |
| 13 | 5 | 27.0 | 34.4 | 38.6 | 241 | 10.0 | 5.9 | Fail |
| 14 | 6 | 29.2 | 29.3 | 41.5 | 204 | 9.9 | 4.9 | Fail |

The invention claimed is:

1. A flame barrier comprising a fiber blend comprising:

a. about 20% (w/w) to less than about 70% (w/w) of flame-retardant Lyocell fibers, wherein said Lyocell fibers comprise from about 12% to about 50% (w/w) of incorporated inorganic additives selected from the group consisting of kaolin, talc, and mixtures thereof, b. at least one fiber selected from the group consisting of natural and synthetic fibers, wherein said fiber blend is capable of imparting to an article of manufacture the ability to pass a test according to 16 CFR 1633; and wherein said flame barrier is capable of forming a stable charred layer when exposed to a flame.

2. The flame barrier according to claim 1, comprising from about 30% (w/w) to about 70% (w/w) of the flame retardant Lyocell fibers.

3. The flame barrier according to claim 1 or 2, wherein the flame barrier comprises a nonwoven material.

4. The flame barrier according to claim 3, wherein the nonwoven material is a high loft nonwoven material.

5. An article of manufacture comprising a flame barrier which comprises a fiber blend comprising:

a. about 20% (w/w) to about 70% (w/w) of flame-retardant Lyocell fibers which comprise from about 12% to about 50% (w/w) of incorporated inorganic additives selected from the group consisting of kaolin, talc, and mixtures thereof, b. at least one fiber selected from the group consisting of natural and synthetic fibers, wherein the article of manufacture is capable of passing a test according to 16 C.F.R. 1633; and wherein the flame barrier is capable of forming a stable charred layer when exposed to a flame.

6. The article of manufacture according to claim 5, wherein said article of manufacture is selected from the group consisting of mattresses, upholstered furniture, cars, airplanes, and carpets.

7. The article of manufacture according to claim 6, wherein said article of manufacture is a mattress.

8. The flame barrier according to claim 1, wherein the flame barrier is for use in an article of manufacture selected from the group consisting of mattresses and upholstered furniture.

9. The flame barrier according to claim 1, wherein the natural and synthetic fibers are selected from the group consisting of cotton and PES.

* * * * *